US009498098B2

(12) United States Patent
Noh

(10) Patent No.: US 9,498,098 B2
(45) Date of Patent: Nov. 22, 2016

(54) TOY ITEM CLEANING DEVICE

(71) Applicant: June Noh, Flushing, NY (US)

(72) Inventor: June Noh, Flushing, NY (US)

( * ) Notice: Subject to any disclaimer, the term of this patent is extended or adjusted under 35 U.S.C. 154(b) by 47 days.

(21) Appl. No.: 14/662,739

(22) Filed: Mar. 19, 2015

(65) Prior Publication Data

US 2016/0270616 A1 Sep. 22, 2016

(51) Int. Cl.
*A47L 9/24* (2006.01)

(52) U.S. Cl.
CPC ..... *A47L 9/248* (2013.01)

(58) Field of Classification Search
CPC ..... A47L 9/248; A47L 9/9009; A47L 9/02; A47L 9/242; A47L 5/28; A47L 7/04
See application file for complete search history.

(56) References Cited

U.S. PATENT DOCUMENTS 4,833,753 A * 5/1989 Muller ..... A47L 9/248 15/339
5,375,293 A * 12/1994 Gilbertson ..... A47L 9/104 15/339
5,768,748 A * 6/1998 Silvera ..... A01K 13/001 119/602
6,216,876 B1 * 4/2001 Quillian, III ..... A01D 46/005 15/300.1
7,979,957 B2 * 7/2011 Meyer ..... A47L 7/009 15/347
2012/0090639 A1 * 4/2012 Heldman ..... A47L 9/248 134/21
2014/0047660 A1 * 2/2014 Factora ..... A47L 9/00 15/246.2

* cited by examiner

*Primary Examiner* — Dung Van Nguyen
(74) *Attorney, Agent, or Firm* — East West Law Group; Heedong Chae

(57) ABSTRACT

A toy item cleaning device includes a toy item container, an inlet pipe, a filtering member and a vacuum hose connector. The toy item container has a first side and a second side such that the first and second sides face each other. The inlet pipe is attached to the first side and the filtering member is directly or indirectly attached to the second side. The filtering member has a plurality of vent holes and the vacuum hose connector is attached to the second side. In addition, the vacuum hose connector is adapted to be detachably connected to a vacuum cleaner hose. The toy item cleaning device further includes a vacuum hose adapter which has concentric tubular sections each section of which is adapted to be connected to a specific size of the vacuum cleaner hose. The tubular sections may be telescopic and designed to slide into one another.

20 Claims, 5 Drawing Sheets

TOY ITEM CLEANING DEVICE

FIELD OF THE INVENTION

The present invention relates to a toy item cleaning device and, more particularly, to a toy item cleaning device for picking up and cleaning toy items such as Lego (Trademark) bricks, building blocks and so forth. The toy item cleaning device is constructed to be attachable to a vacuum cleaner.

BACKGROUND OF THE INVENTION

Children and kids enjoy playing with toys and toy building blocks such as Lego (Trademark) bricks are very popular among children. However, picking up a number of building blocks is an exhausting chore and cleaning grubby blocks is very hard.

Therefore, to solve the above problems, there is a need for a toy item cleaning device for picking up and cleaning toy items. This invention is directed to solve these problems and satisfy the long-felt need.

SUMMARY OF THE INVENTION

The present invention contrives to solve the disadvantages of the prior art. The present invention provides a toy item cleaning device for picking up and cleaning toy items.

The object of the present invention is to provide a toy item cleaning device, having a toy item container, an inlet pipe, a filtering member and a vacuum hose connector. The toy item container has a first side and a second side such that the first and second sides face each other. The inlet pipe is attached to the first side and the filtering member is directly or indirectly attached to the second side. The filtering member has a plurality of vent holes and the vacuum hose connector is attached to the second side. In addition, the vacuum hose connector is adapted to be detachably connected to a vacuum cleaner hose.

Another object of the present invention is to provide a toy item cleaning device, having a toy item container, an inlet pipe, a filtering member and a vacuum hose connector. The toy item cleaning device further includes a vacuum hose adapter which has concentric tubular sections each section of which is adapted to be connected to a specific size of the vacuum cleaner hose. The tubular sections may be telescopic and designed to slide into one another.

Still another object of the present invention is to provide a toy box for picking up and cleaning toy items. The toy box includes a toy item container substantially in a shape of a rectangular parallelepiped, having a top side, a bottom side, a first side, a second side, a third side, and a fourth side wherein the top side is constructed to be a lid and the first and second sides face each other. An inlet pipe is attached to the first side and a vacuum hose connector attached to the second side. A filtering member is directly or indirectly attached to the second side and the filtering member has a plurality of vent holes. The vacuum hose connector is adapted to be detachably connected to a vacuum cleaner hose.

The advantages of the present invention are: (1) the toy item cleaning device of the present invention is easy to use and constructed to be attachable to a vacuum cleaner hose for use; (2) the toy item cleaning device of the present invention effectively sucks up and picks up toy items into a toy item container and cleans the toy items; (3) the toy item cleaning device of the present invention picks up toy items and the filtering member prevents the toy items from being sucked into the vacuum cleaner while allowing dusts passage of dusts or other small trashes; (4) the toy item container is transparent and it is visible to see toy items being sucked into the container; (5) the present invention not just sucks up toy items, but also cleans the toy items, brushing off dusts on the toy items; and (6) the toy item cleaning device of the present invention has a simple structure and it is easy and inexpensive to manufacture the same.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed, herein, as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
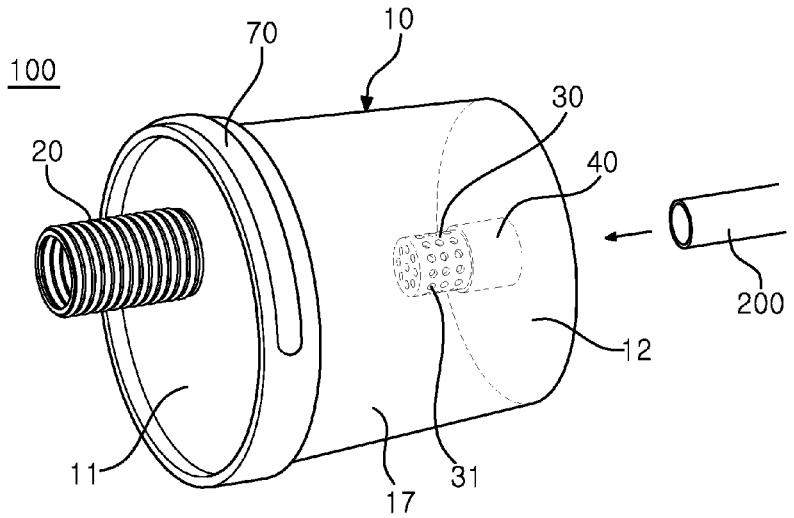
FIG. 1 shows a perspective view of a toy item cleaning device according to one embodiment of the present invention.
Figure 2:
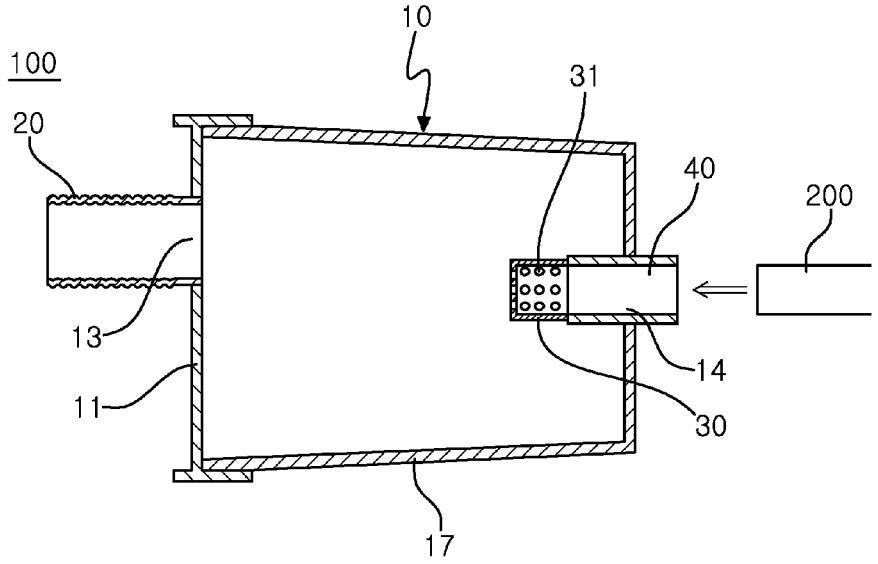
FIG. 2 shows a cross-sectional view of the toy item cleaning device.
Figure 3:
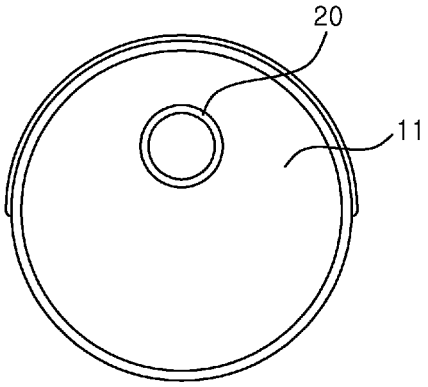
FIG. 3 shows a left side elevational view of the toy item cleaning device.
Figure 4:
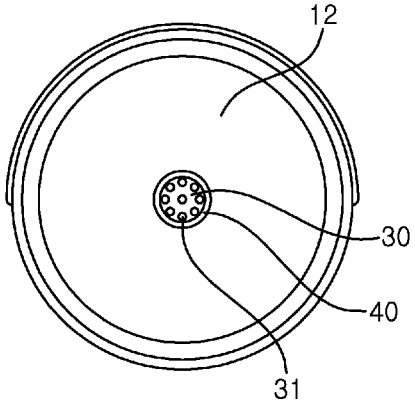
FIG. 4 shows a right side elevational view of the toy item cleaning device.

FIG. 1 shows a perspective view of a toy item cleaning device 100 according to one embodiment of the present invention and FIG. 2 shows a cross-sectional view thereof. FIGS. 3 and 4 respectively show left and right side views of the toy item cleaning device 100.

The toy item cleaning device 100 includes a toy item container 10, having a first side 11 and a second side 12 such that the first and second sides 10 and 11 face each other; an inlet pipe 20 attached to the first side 11; a filtering member 30 directly or indirectly attached to the second side 12, having a plurality of vent holes 31; and a vacuum hose connector 40 attached to the second side 12. The vacuum hose connector 40 is adapted to be detachably connected to a vacuum cleaner hose 200. The inlet pipe 20 is sized enough to allow passage of certain sizes of toy items 60 and the vent holes 31 are sized to prevent passage of the certain sizes of toy items, but allow passage of dust or other smaller sizes of trashes.

Toy items have various sizes. For example, Logo (Trademark) bricks has the sizes of multiplicity of 8 mm, 4 knobs brick has about 32 mm in length, 6 knobs brick 48 mm in length, and so on. 16 knobs beam has 128 mm in length.

For instance, the inlet pipe 20 may be sized about 50 mm in diameter to allow passage of up to 6 knobs brick. However, even bigger bricks can pass through the inlet pipe 20 if they enter the inlet pipe 20 in lengthwise direction.

The vent holes 31 may be sized less than 8 mm in diameter to prevent the smallest Lego brick. Preferably, the vent holes 31 may have about 3-6 mm in diameter to prevent small sizes of toy items, but allow passage of dust or other smaller sizes of trashes.

The filtering member 30 may be made in various shapes, but preferably, the filtering member 30 may have a top and a side. As shown in FIG. 1, the top is circular and the side cylindrically extends from the top. The vent holes 31 are formed on both of the top and side.

The filtering member 30 may be made of plastic or metal. If metal, the filtering member 30 may be made of stainless steel or aluminum.

Preferably, the toy item container 10 is transparent so that it is visible for toy items 60 to be picked up into the toy item container 10. It will be a lot of fun to watch toy items 60 being sucked up into the container 10 and being randomly moved around therein, and children may want to and do cleaning up toy items 60 by themselves while their parents are looking.

The filtering member 30 and the vacuum hose connector 40 may be directly attached to the second side 12. Alternatively, the filtering member 30 may be attached to the vacuum hose connector 40 and the vacuum hose connector 40 may be attached to the second side 12.

The first side 11 may be a removable lid and a handle 70 may be attached to the lid 11 as shown in FIG. 1.

Additional handle, may be formed on outer boundary of the vacuum hose connector 40.

Figure 9:
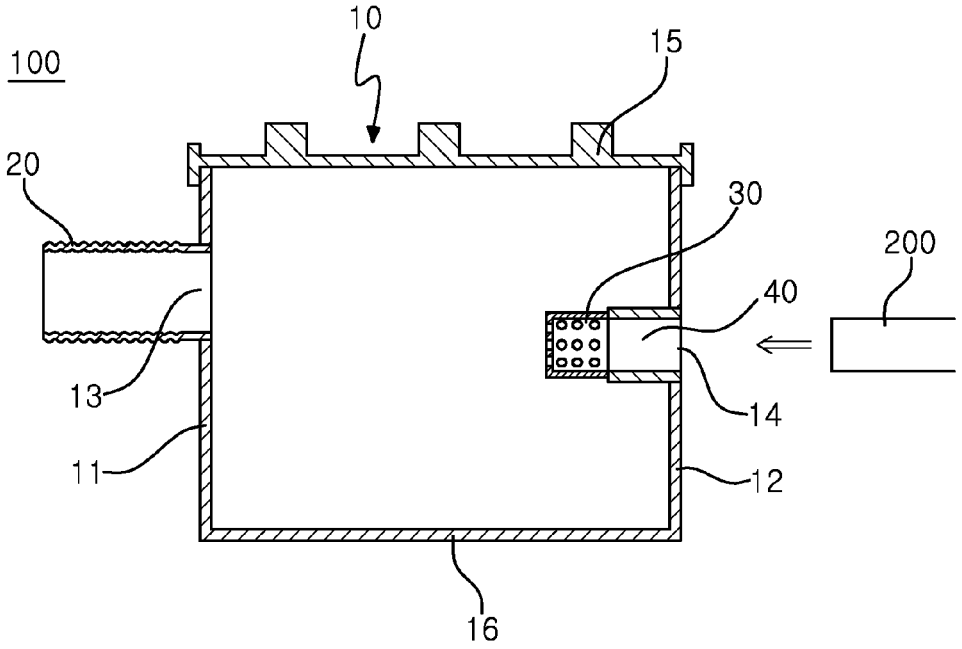
FIG. 9 shows a cross-sectional view of a toy item cleaning device according to still another embodiment of the present invention.

The toy item cleaning device 100 may further comprise a third side and the third side 15 may be a removable lid as shown in FIG. 9.

The vacuum hose connector 40 may be made of plastic. Alternatively, the vacuum hose connector 40 may be made of resilient material flexible enough to receive the vacuum cleaner hose 200, but contractible enough to securely grip the vacuum cleaner hose 200 by a friction fit.

In another embodiment, the vacuum hose connector 40 does not extend beyond a furthest portion of the second side 12 such that the toy item container 10 can stably stand on the second side 12 when the vacuum cleaner hose 200 is not attached to the vacuum hose connector 40. As in FIG. 5, the second side 12 is flat or may have a circular protrusion to support the toy item container 10.

Figure 5:
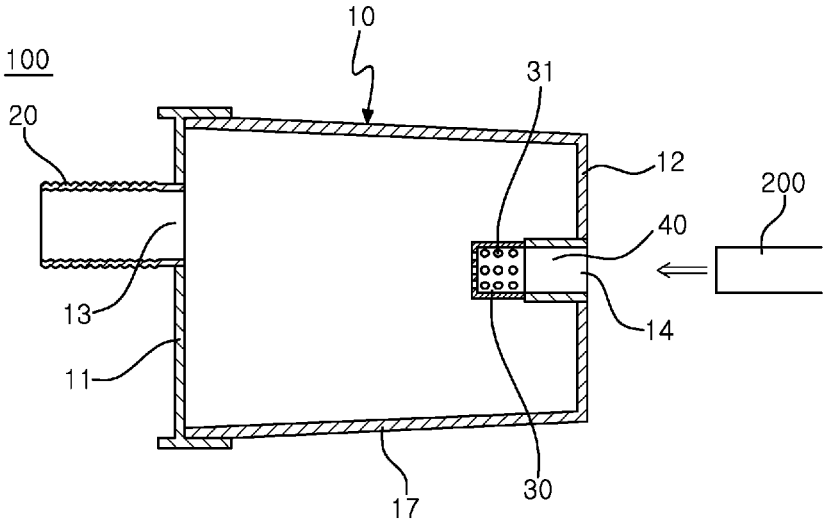
FIG. 5 shows a cross-sectional view of a toy item cleaning device according to another embodiment of the present invention.

FIG. 5 shows a cross-sectional view of a toy item cleaning device 100 according to another embodiment of the present invention. In this embodiment, the device 100 itself is a toy box.

A toy box 100 for picking up toy items includes a toy item container 10, having a top side 11 and a bottom side 12 wherein the top side 11 is constructed to be a lid; an inlet pipe 20 attached to the top side 11; a vacuum hose connector 40 attached to the bottom side 12 wherein the vacuum hose connector 40 is adapted to be detachably connected to a vacuum cleaner hose 200; and a filtering member 30 attached to the vacuum hose connector 40. The filtering member 30 has a plurality of vent holes.

The inlet pipe 20 is sized enough to allow passage of certain sizes of toy items 60 and the vent holes 31 are sized to prevent passage of certain sizes of toy items 60, hut allow passage of dust or other smaller trashes. In addition, the toy item container 40 does not extend beyond a furthest portion of the bottom side 12 such that the toy item container 10 can stably stand on the bottom side 12 when the vacuum cleaner hose 200 is not attached to the vacuum hose connector 40.

As shown in FIG. 5 as applied to FIG. 1, the top and bottom sides 11 and 12 are circular and the toy item container 10 is substantially in a shape of cylinder or conical frustum (truncated cone).

The filtering member 30 has a top and a side. The top is circular and the side cylindrically extends from the top. Furthermore, the vent holes 31 are formed on the top and side.

Figure 6:
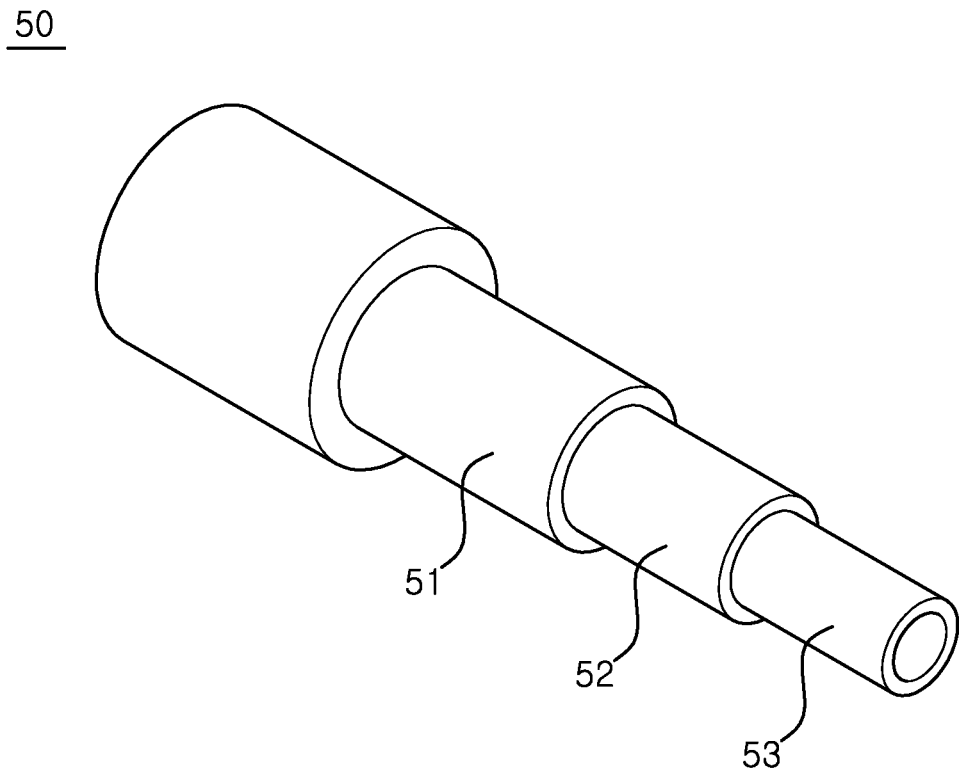
FIG. 6 shows a perspective view of a vacuum hose adapter according to the present invention.
Figure 7:
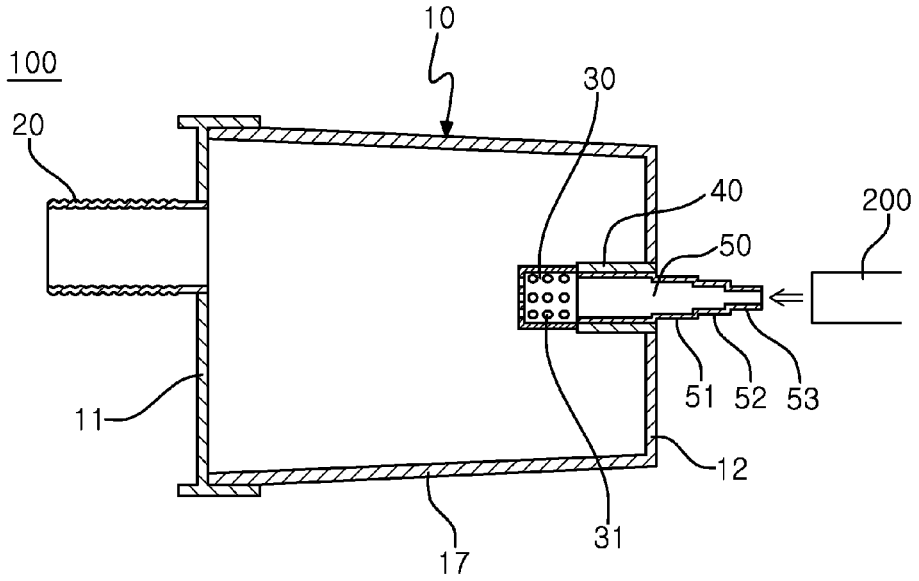
FIG. 7 shows a cross sectional view of the toy item cleaning device with the vacuum hose adapter attached.

FIG. 6 shows a perspective view of a vacuum hose adapter 50 according to the present invention and FIG. 7 shows a cross sectional view of the toy item cleaning device 100 with the vacuum hose adapter 50 attached.

The vacuum hose adapter 50 has a first end and a second end such that the first end is adapted to be connected to the vacuum hose connector 40 and the second end is adapted to be connected to the vacuum cleaner hose 200. The first and second ends have different sizes of diameters so that the second end can accommodate different size of the vacuum cleaner hose.

As shown in FIG. 6, the second end may be constructed to have a plurality of concentric tubular sections 51, 52, and 53 each section of which is adapted to be connected to a specific size of the vacuum cleaner hose 200. In this way, the present invention 100 can be attached to various sizes of a vacuum cleaner hose 200. The tubular sections 51, 52, and 53 have different outer diameters to accommodate various inner diameters of vacuum cleaner hoses. In addition, the smallest section 53 may receive a vacuum cleaner hose therein if the vacuum cleaner hose fits in.

Additionally, the second end of the vacuum hose adapter 50 may have telescopic tubular sections 51, 52, and 53 such that the concentric tubular sections 51, 52, and 53 are designed to slide into one another.

Figure 8:
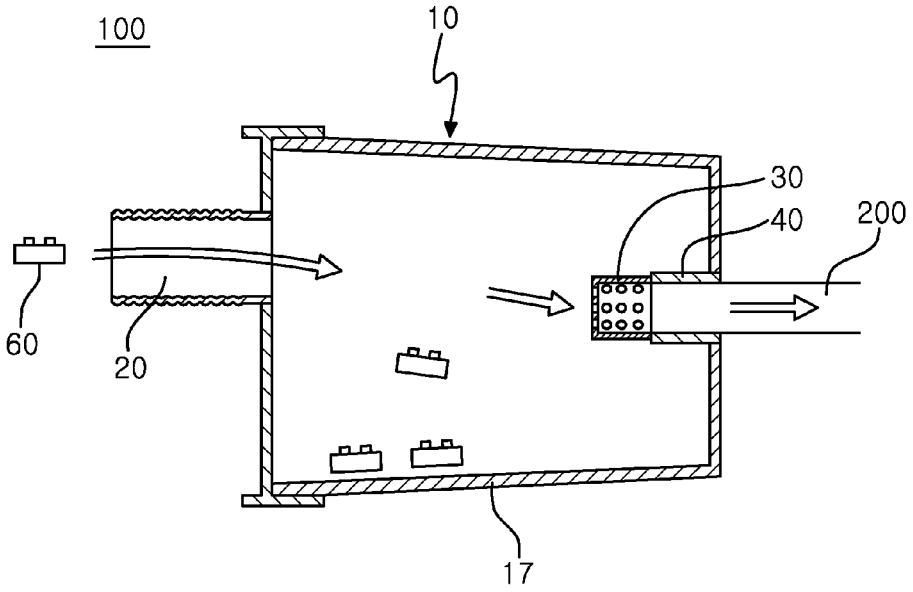
FIG. 8 shows a cross sectional view of a schematic diagram illustrating the air flow by the toy item cleaning device of the present invention.

FIG. 8 illustrates the air flow by the toy item cleaning device 100. The first side 11 has an inlet opening 13 and the second side 12 has an outlet opening 14. The inlet and outlet openings 13 and 14 are constructed so that air can flow from outside through the inlet pipe 20, through the inlet opening 13, through the toy item container 10, through the filtering member 30, through the outlet opening 14, and to the vacuum cleaner hose 200. The vacuum hose connector 40 may be located before or after or both of the outlet opening 14.

The outlet opening 14 may be preferably formed at about a center of the second side 12. However, the inlet opening 13 may not be formed at about a center of the first side 11, but it may be formed near outer rim of the first side 11. By this construction, the toy item cleaning device 100 can suck up and store more toy items.

FIG. 9 shows a cross-sectional view of a toy item cleaning device 100 according to still another embodiment of the present invention. In this embodiment, the device 100 itself is a toy box.

A toy box 100 for picking up toy items includes a toy item container 10 substantially in a shape of a rectangular parallelepiped, having a top side 15, a bottom side 16, a first side 11, a second side 12, a third side, and a fourth side wherein the top side 15 is constructed to be a lid and the first and second sides 11 and 12 face each other; an inlet pipe 20 attached to the first side 11; a filtering member 30 directly or indirectly attached to the second side 12 wherein the filtering member 30 has a plurality of vent holes 31; and a vacuum hose connector 40 attached to the second side 12 wherein the vacuum hose connector 40 is adapted to be detachably connected to a vacuum cleaner hose 200.

The inlet pipe 20 is sized enough to allow passage of certain sizes of toy items 60, and the vent holes 31 are sized to prevent passage of certain sizes of toy items 60, but allow passage of dust or other smaller trashes.

The filtering member 40 has a top and a side. The top is circular and the side cylindrically extends from the top. In addition, the vent holes 31 are formed on the top and side.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A toy item cleaning device, comprising:

a toy item container, having a first side and a second side wherein the first and second sides face each other;

an inlet pipe attached to the first side;

a filtering member directly or indirectly attached to the second side wherein the filtering member has a plurality of vent holes;

a vacuum hose connector attached to the second side wherein the vacuum hose connector is adapted to be detachably connected to a vacuum cleaner hose; and a vacuum hose adapter having a first end and a second end wherein the first end is adapted to be connected to the vacuum hose connector and the second end is adapted to be connected to the vacuum cleaner hose, wherein the first and second ends have different sizes of diameters, wherein the inlet pipe is sized enough to allow passage of certain sizes of toy items, wherein the vent holes are sized to prevent passage of certain sizes of toy items, but allow passage of dust.

2. The toy item cleaning device of claim 1, wherein the filtering member has a top and a side, wherein the top is circular and the side cylindrically extends from the top, wherein the vent holes are formed on the top and side.

3. The toy item cleaning device of claim 1, wherein the filtering member is made of metal.

4. The toy item cleaning device of claim 1, wherein the filtering member is made of stainless steel or aluminum.

5. The toy item cleaning device of claim 1, wherein the filtering member is attached to the vacuum hose connector and the vacuum hose connector is attached to the second side.

6. The toy item cleaning device of claim 5, wherein the vacuum hose connector does not extend beyond a furthest portion of the second side such that the toy item container can stably stand on the second side when the vacuum cleaner hose is not attached to the vacuum hose connector.

7. The toy item cleaning device of claim 1, wherein the first side is a removable lid.

8. The toy item cleaning device of claim 1, further comprises a third side and the third side is a removable lid.

9. The toy item cleaning device of claim 1, wherein the vacuum hose connector is made of resilient material flexible enough to receive the vacuum cleaner hose, but contractible enough to securely grip the vacuum cleaner hose by a friction fit.

10. The toy item cleaning device of claim 1, wherein the second end is constructed to have a plurality of concentric tubular sections each section of which is adapted to be connected to a specific size of the vacuum cleaner hose.

11. The toy item cleaning device of claim 1, wherein the first side has an inlet opening and the second side has an outlet opening, wherein the inlet and outlet openings are constructed so that air can flow from outside through the inlet pipe, through the inlet opening, through the toy item container, through the filtering member, through the outlet opening, and to the vacuum cleaner hose.

12. The toy item cleaning device of claim 11, wherein the outlet opening is formed at about a center of the second side.

13. The toy item cleaning device of claim 11, wherein the inlet opening is not formed at about a center of the first side.

14. A toy box for picking up toy items, comprising a toy item container, having a top side and a bottom side wherein the top side is constructed to be a lid;

an inlet pipe attached to the top side;

a vacuum hose connector attached to the bottom side wherein the vacuum hose connector is adapted to be detachably connected to a vacuum cleaner hose;

a filtering member attached to the vacuum hose connector wherein the filtering member has a plurality of vent holes; and a vacuum hose adapter having a first end and a second end wherein the first end is adapted to be connected to the vacuum hose connector and the second end is adapted to be connected to the vacuum cleaner hose, wherein the first and second ends have different sizes of diameters, wherein the inlet pipe is sized enough to allow passage of certain sizes of toy items, wherein the vent holes are sized to prevent passage of certain sizes of toy items, but allow passage of dust, wherein the vacuum hose connector does not extend beyond a furthest portion of the bottom side such that the toy item container can stably stand on the bottom side when the vacuum cleaner hose is not attached to the vacuum hose connector.

15. The toy box of claim 14, wherein the top and bottom sides are circular and the toy item container is substantially in a shape of cylinder or conical frustum.

16. The toy box of claim 14, wherein the filtering member has a top and a side, wherein the top is circular and the side cylindrically extends from the top, wherein the vent holes are formed on the top and side.

17. The toy box of claim 14, wherein the second end is constructed to have a plurality of concentric tubular sections each section of which is adapted to be connected to a specific size of the vacuum cleaner hose.

18. A toy box for picking up toy items, comprising a toy item container substantially in a shape of a rectangular parallelepiped, having a top side, a bottom side, a first side, a second side, a third side, and a fourth side wherein the top side is constructed to be a lid and the first and second sides face each other;

an inlet pipe attached to the first side;

a filtering member directly or indirectly attached to the second side wherein the filtering member has a plurality of vent holes;

a vacuum hose connector attached to the second side wherein the vacuum hose connector is adapted to be detachably connected to a vacuum cleaner hose, wherein the inlet pipe is sized enough to allow passage of certain sizes of toy items; and a vacuum hose adapter having a first end and a second end wherein the first end is adapted to be connected to the vacuum hose connector and the second end is adapted to be connected to the vacuum cleaner hose, wherein the first and second ends have different sizes of diameters, wherein the vent holes are sized to prevent passage of the certain sizes of toy items, but allow passage of dust.

19. The toy box of claim 18, wherein the filtering member has a top and a side, wherein the top is circular and the side cylindrically extends from the top, wherein the vent holes are formed on the top and side.

20. The toy box of claim 18, wherein the second end is constructed to have a plurality of concentric tubular sections each section of which is adapted to be connected to a specific size of the vacuum cleaner hose.

* * * * *